United States Patent [19]

Eheim

[11] 4,403,583

[45] Sep. 13, 1983

[54] FUEL INJECTION PUMP

[75] Inventor: Franz Eheim, Stuttgart, Fed. Rep. of Germany

[73] Assignee: Robert Bosch GmbH, Stuttgart, Fed. Rep. of Germany

[21] Appl. No.: 124,888

[22] Filed: Feb. 26, 1980

[30] Foreign Application Priority Data

Mar. 10, 1979 [DE] Fed. Rep. of Germany ..... 2909555

[51] Int. Cl.[3] ..... F02D 17/06

[52] U.S. Cl. ..... 123/387; 123/366; 123/179 L

[58] Field of Search ..... 123/366, 387, 385, 179 L, 123/502, 568

[56] References Cited

U.S. PATENT DOCUMENTS

| | | | |
|---|---|---|---|
| 3,096,747 | 7/1963 | Tado | 123/364 |
| 3,405,700 | 10/1968 | Hoefer | 123/449 |
| 3,443,554 | 5/1969 | Kleeberger | 123/387 |
| 4,170,976 | 10/1979 | Eckert | 123/387 |
| 4,214,564 | 7/1980 | Skinner | 123/179 L |
| 4,248,193 | 2/1981 | Choma | 123/568 |
| 4,273,090 | 6/1981 | Höfer | 123/502 |
| 4,278,058 | 7/1981 | Berner | 123/387 |

*Primary Examiner*—Charles J. Myhre
*Assistant Examiner*—Carl Stuart Miller
*Attorney, Agent, or Firm*—Edwin E. Greigg

[57] ABSTRACT

A fuel injection pump having a hydraulic governor is proposed wherein as a result of the use of a piston adjustable under rpm-dependent pressure counter to the action of governor springs, a very precise control is attainable with only small forces being brought to bear and with adjustment paths which are easily adaptable to given conditions.

19 Claims, 10 Drawing Figures

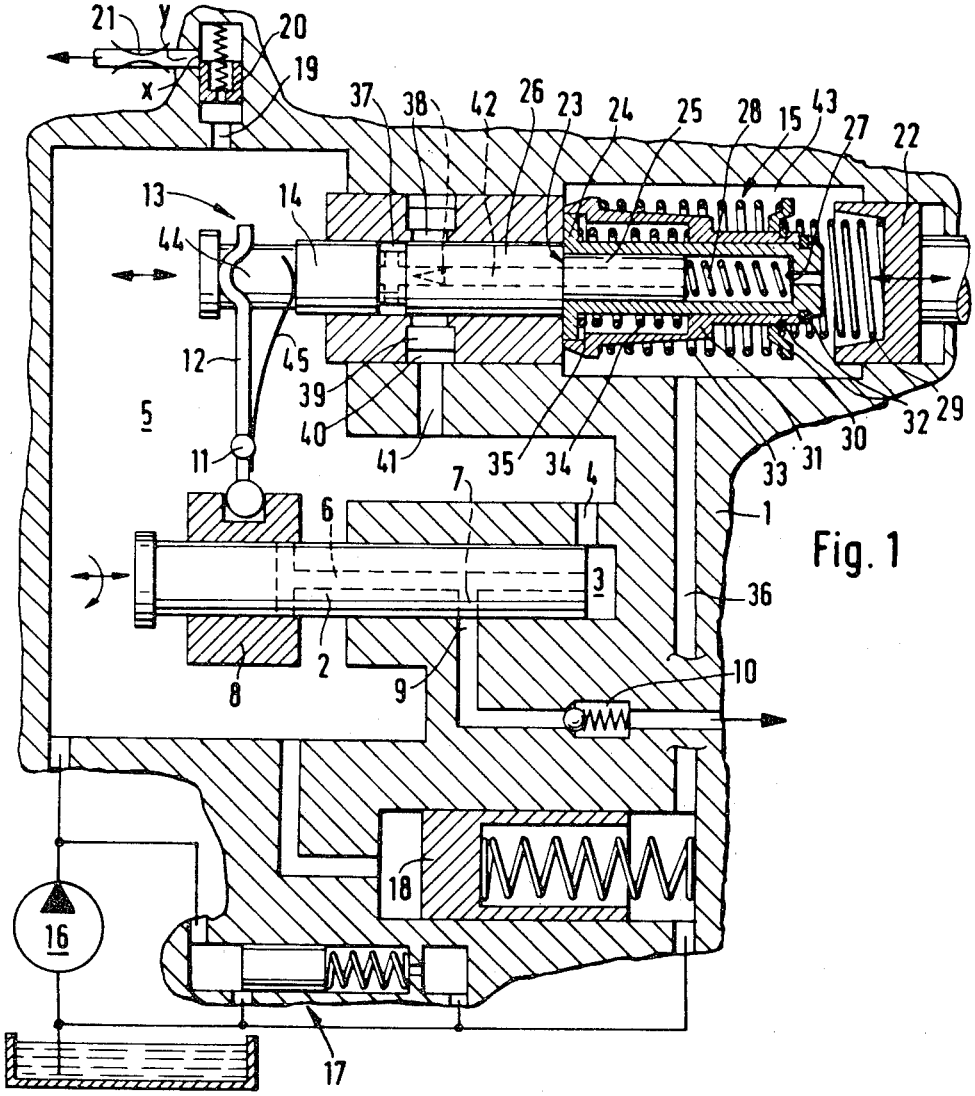
Fig. 1
Fig. 2
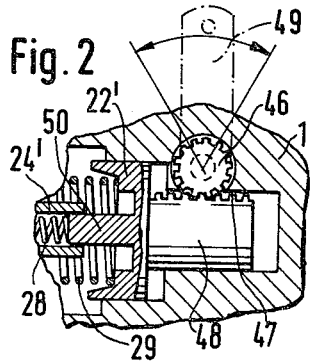
Fig. 3
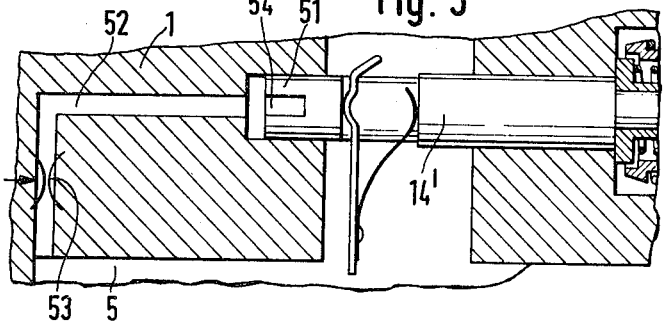

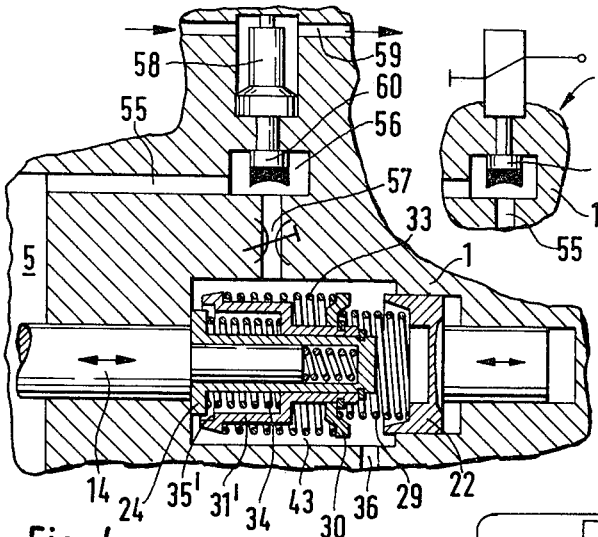
Fig. 4
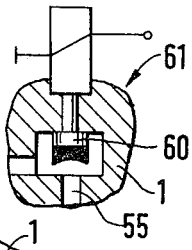
Fig. 5
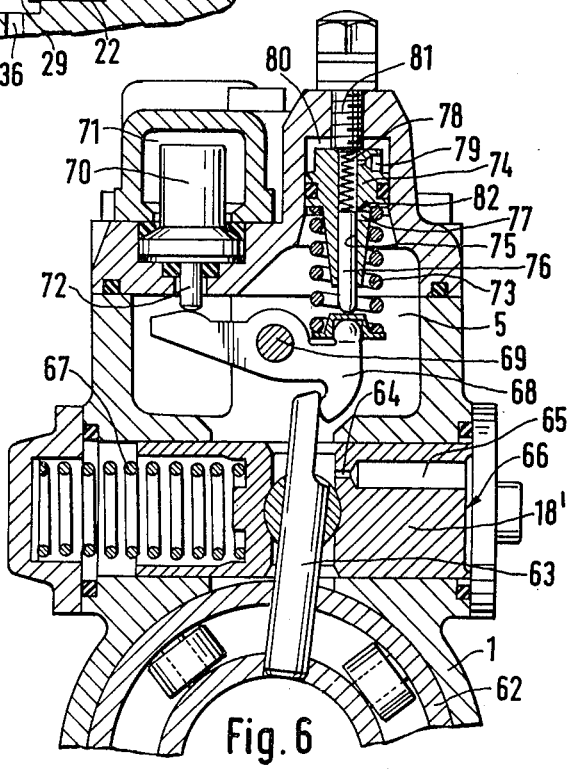
Fig. 6
Fig. 7
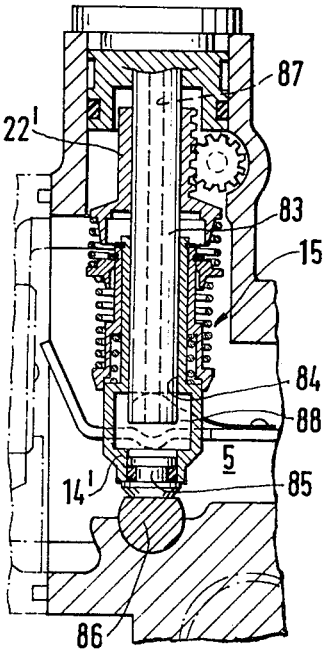
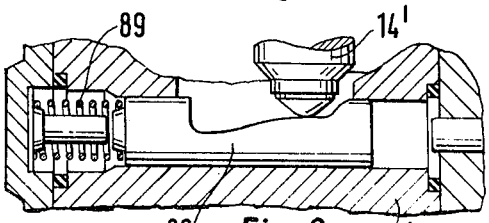
Fig. 8

FUEL INJECTION PUMP

BACKGROUND OF THE INVENTION

The invention relates to a fuel injection pump. In a known fuel injection pump of this kind, a diaphragm which first limits the possible adjustment path to a predetermined extent and second has some force influence on the control variable acts as the adjusting member. Furthermore, if the diaphragm is destroyed by a spring which does not act as the governor spring, the fuel quantity control member is displaced in the direction of a large injection quantity, which can cause the engine to race. In the governor of this known fuel injection pump, the pressure is thus controlled in accordance with load by way of a throttle that depends on the position of the adjustment lever, which means that there is great dependence on temperature and there are also the known disadvantages of throttle control.

OBJECT AND SUMMARY OF THE INVENTION

The fuel injection pump according to the invention has the advantage over the prior art that in addition to a high level of control reliability and a very small degree of hysteresis long travel paths can be attained with a small governor, in order to apply correspondingly large adjustment forces for the fuel quantity control member. In addition, a proven system having the fuel pressure in the suction chamber controlled with rpm is used, while the governor forces, because of the use of the principle of balance of forces between the pressure and the spring force, are in full view and are accordingly easy to adjust.

The invention will be better understood and further objects and advantages thereof will become more apparent from the ensuing detailed description of preferred embodiments taken in conjunction with the drawings.

BRIEF DESCRIPTION OF THE DRAWINGS

FIG. 1 is a simplified cross-sectional representation of the fuel injection pump with the governor in lengthwise section;

FIG. 2 shows schematically the gear assembly for the adjustment of the governor springs;

FIG. 3 shows an enlarged detail view of the hydraulic piston being acted upon in a throttled fashion;

FIGS. 4 and 5 show the control means for an increase in idling quantity in accordance with temperature;

FIG. 6 shows in cross section a combination of an adjustment toward "early" during cold starting and the increase of idling quantity in accordance with temperature;

FIGS. 7 and 8 show an adjustment of the adjusting piston for starting accomplished by means of a three-dimensional cam;

DESCRIPTION OF THE PREFERRED EMBODIMENTS

Figure 10:
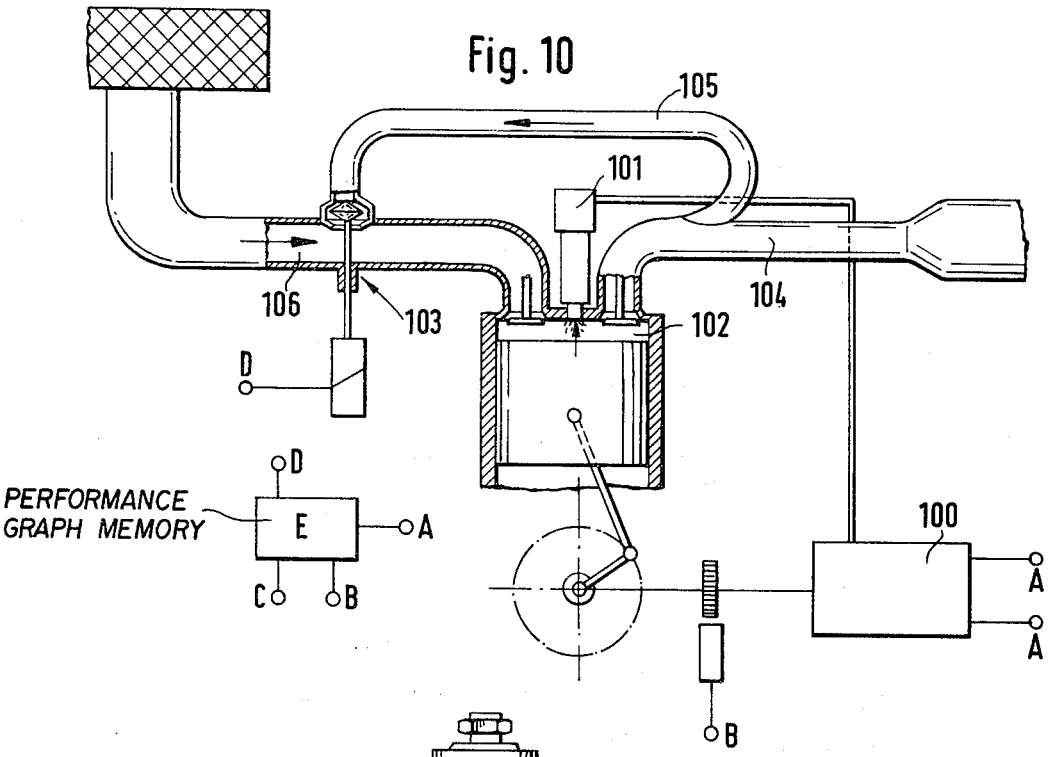
FIG. 10 shows the control of exhaust gas recirculation in an internal combustion engine system using the pump in accordance with the invention.

In FIG. 1, a fuel injection pump in accordance with the invention is shown in greatly simplified form. A pump piston 2 moves within a housing 1 of this fuel injection pump, being set into simultaneously reciprocating and rotary motion by a cam drive which is not shown. The pump piston 2 defines a pump work chamber 3 in the housing 1 which communicates via an inflow channel 4 with the pump suction chamber 5 disposed in the housing 1. A pressure channel 6 is disposed in the pump piston 2, is arranged to discharge into the pump work chamber 3, and has a distributor bore 7 which branches off from it. This pressure channel is controlled by an annular slide 8 acting as the fuel quantity control member. The distributor bore 7 cooperates with pressure lines 9, which are distributed generally uniformly about the pump piston and each of which contains a check valve 10. During the suction stroke of the pump, fuel proceeds out of the suction chamber 5, via the inflow channel 4, and into the pump work chamber 3. During the subsequent compression stroke of the pump piston 2, the fuel, which is under high pressure after the closing of the inflow channel 4 via the distributor bore 7, is carried to one of the pressure lines 9, in order to proceed thereby and via a fuel injection valve (not shown) into a cylinder of the internal combustion engine being supplied. After an appropriate compression stroke has been performed, the pressure channel 6 in the pump piston 2 is opened by the annular slide 8 in order to terminate the injection. This action is accomplished by arranging a mouth of the pressure channel 6 so that it emerges from the annular slide 8 during the compression stroke movement.

The fuel quantity is thus dependent on the position of the annular slide 8, which is adjustable, via a governor lever 12 supported at 11, by means of a hydraulic governor 13. The hydraulic governor 13 functions with an adjusting piston 14 one end face of which is exposed to the fuel from the suction chamber 5, and on the opposite end a spring unit 15 engages the piston, the forces of this spring unit 15 being arbitrarily variable. The suction chamber 5 receives the fuel from a supply pump 16, which is driven at a rotary speed synchronous with the pump (this drive generally being integrated in the pump), with the pressure in the suction chamber 5 being controlled via a pressure control valve 17 in accordance with rpm; that is, the pressure increases with increasing rpm.

A piston 18 of an injection time adjustment device is also under the influence of the suction chamber 5, as is described in greater detail in connection with FIG. 6.

A discharge channel 19 branches off from the suction chamber 5 in the housing 1 and has an overflow valve 20 disposed therein which acts as a constant-flow valve. A throttle valve 21 may be disposed subsequent to this overflow valve 20 in order to exert an influence on the control pressure. The function of the overflow valve or of the subsequent throttle valve is as follows:

The overflow quantity is controlled by means of the cross section x between the slide shaft and the bore y as a result of the hydraulic balance—that is, the ratio of pressure times surface area on the front face of the slide to the reduced pressure on the back face of the slide times the slide surface area plus the spring force.

The spring unit 15 is arranged to act counter to the hydraulic force that engages the piston 14 and may comprise one spring or a plurality of springs, which cooperate via spring plates and are advantageously disposed in series with respect to their function. In every case, the force of at least one spring can be varied by means of a coupler member 22 (FIG. 2), which (embodied here as a piston) is disposed coaxially with the actual adjusting piston in the housing 1 and is axially adjustable from outside the pump housing 1 by means of an adjusting lever shown in FIG. 2. After the coupler member 22 is removed, the spring unit 15 can be separated from the adjusting piston 14 in a very simple manner and then exchanged; or, with the same basic embodiment, different spring units can be assembled therewith. The adjusting piston 14 has a step or shelf area 23, which serves as a contact for a hat-shaped cap 24, which is placed over the reduced or stub portion 25 of the adjusting piston 14. The hat-shaped cap 24 may be supported with its flanged area on the housing 1; in the illustrated example, it is supported on a ring 26 attached to the housing. A starting spring 28 is disposed between the base 27 of the cap 24 and the end face of the stub portion 25 of the adjusting piston 14. When the engine is stopped, the starting spring 28 pushes the adjusting piston 14 and thus the stub portion 25 a predetermined distance out of the cap 24, whereby in turn the annular slide 8 of the injection pump is displaced to such an extent (to the right, as shown in the drawing) that the mouth of the pressure channel no longer emerges from the annular slide 8, accordingly, the entire fuel quantity supplied by the fuel injection pump is injected as a starting quantity. Then, as soon as the engine is started and a predetermined pressure has been established via the supply pump 16 in the suction chamber 5, the adjusting piston is pushed against the starting spring 28, until the shoulder 23 strikes the cap 24, which corresponds to the position of the annular slide 8 for full load.

The idling rpm is governed by an idling spring 29, which is supported at one end on the coupler member 22 and on the other end on an intermediate spring plate 30, which is supported in axially displaceable fashion in the direction of the force of the spring 29 on a spring plate bushing 31, which is likewise disposed in axially displaceable fashion in the same direction on the cap 24. The freedom of motion in the opposite direction is prevented in each case by a securing ring 32 that is disposed on the cap 24 and is adapted to abut the spring plate bushing 31. A governor spring 33 engages the side of the intermediate spring plate 30 remote from the idling spring 29 and is supported on the other end on the spring plate bushing 31. An adaptation spring 34 is disposed between the spring plate bushing 31 and the hat-shaped cap 24, with the travel path of the cap 24—that is, the variation of the force of the adaptation spring 34—being limited by a shoulder 35 provided on the spring plate bushing 31.

The governor functions as follows: After starting of the engine and the compression of the starting spring 28, and as long as the coupler member 22 is in the idling position corresponding to idling rpm, the adjusting piston 14, including the spring unit 15, is displaced toward the right and toward the coupler member 22 by the fuel pressure in the suction chamber 5. At the same time, the annular slide 8 is displaced toward the left, until the injection quantity effects an idling rpm which is governed by means of a remnant spring travel path of the idling spring 29 which has a degree of disuniformity which is as low as possible. In FIG. 1, the adjusting piston 14 assumes the position after starting, but before the displacement into the idling position. In contrast, the coupler member 22 is displaced out of the idling position toward the right, in the direction of the adjusting piston 14. That is, as soon as the adjusting piston 14 with the spring packet 15 has been displaced toward the right when there is sufficient pressure in the suction chamber 5, idling is no longer attained; instead, a fuel injection quantity is effected which corresponds to partial load. Now, as soon as the load on the engine decreases, the rpm and thus the pressure in the suction chamber 5 increases, and the adjusting piston 14 displaces the sleeve 24 and the spring plate bushing 31 toward the right against the force of the governor spring 33, which then causes a downward control of the fuel injection quantity. Depending upon how the coupler member 22 is displaced by the gas pedal, a different fuel injection quantity is thus established. For example, after exceeding the maximum permissible rpm, the spring 33 is compressed and a downward control of the fuel supply is effected accordingly. In FIG. 1, the spring unit 15 assumes the position for full load—that is, a position which is assumed during operation of the engine whenever it is brought about by means of the coupler member 22 when it is pushed against the spring plate 30 (full load position). This governor thus functions as an idling end governor, that is, a governor which governs solely the idling or final rpm. In the intermediate-load positions, the injection quantity is determined by the driver of the vehicle equipped with an engine having this device thereon. In the example shown in FIG. 1, the spring plate bushing 31 is supported in the full-load position on the ring 26 that is associated with the housing 1, so that the adaptation spring 34 can be effective over the entire arbitrary adjustment range, and in particular at full load. That is, at full load, even when the spring plate bushing 31 is resting against the ring 26 the cap 24 can travel the distance of an adaptation path before the downward control occurs as a result of compression of the governor spring 33.

The chamber 43 which encloses the spring unit 15, into which the coupler member 22 protrudes on one end and the adjusting piston 14 protrudes on the other end, is relieved of pressure toward the suction side of the supply pump via a channel 36. In the governor in accordance with the invention, the principle of balance between the hydraulic pressure on one side and the spring forces on the other side is optimally attained by means of the favorable structural arrangement and the small structural space required. In accordance with the invention, the spring unit 15 also can be so embodied that the governor functions as an adjustment governor; that is, that a certain rpm of the engine corresponds to every position of the coupler member 22. To this end, the governor spring 33 would then function not only during downward control, but would act as the governor spring over the entire adjustment range.

An additional opportunity for introducing an adjustment variable for load dependence into the control circuit is offered, as in the exemplary embodiment shown in FIG. 1, in that a portion of the fuel located in the suction chamber 5 flows out under load-dependent control, as a result of which the pressure also changes in a load-dependent manner. This causes, on the one hand, a corresponding change in the pressure exerted on the adjusting piston 14, and, on the other hand, a change in the adjustment variable of the piston 18. As a result, the onset of injection is changed in accordance with load, as will be particularly well understood by studying FIG. 6 in connection with FIG. 1. In order to control this outflow in an intended manner, an annular groove 37 is disposed in the adjusting piston 14, which cooperates with control slits 38 in the ring 26 attached to the housing. The control slits 38 communicate with the suction chamber 5 via bores 39, an annular groove 40—each disposed in the bushing 26—and a bore 41. The annular groove 41 is connected by a channel 42 which extends within the adjusting piston 14 and is arranged to discharge on the spring side thereof with the chamber 43 which is relieved of pressure and encloses the spring unit 15. Depending upon the position of the adjustment piston 14, the annular groove 37 overlaps the control slits 38, which may be triangular in form, for example, to a greater or lesser extent. Because the position of the adjusting piston is load-dependent, the discharge cross section is accordingly likewise load-dependent. Accordingly, the pressure in the suction chamber 5 does not increase in proportion to the rpm, but rather, depending on the load, in somewhat less than proportional fashion as the load increases. The lower pressure thus resulting at maximum rpm can be compensated for accordingly on the part of the spring. This opportunity for a load-dependent adjustment in control is only one of various possibilities.

In order to enable a displacement by the governor lever 12 of the annular slide 8 in the direction of a shutoff of the engine independently of the position of the governor 13, the governor lever 12, on the side remote from the annular slide 8, engages a relatively wide annular groove 44 of the adjusting piston 14, with a play-compensating spring 45 being arranged to cause the governor lever 12 to be automatically coupled with the adjusting piston 14 only in the direction of downward control of the fuel supply. Accordingly, the governor lead 12 is arbitrarily adjustable only in this direction.

As is shown in FIG. 2, the coupler member 22' can be axially displaced via a gear, wherein a pinion 46 supported in the pump housing 1 meshes with a rack 47, which is disposed on a bolt 48 also supported in the housing 1, with the pinion 46 being rotatable by means of an adjustment lever 49 actuatable from outside the pump housing. The intervention of the guide value (i.e., load) via this gear and the coupler member 22' is accomplished additionally via a tang 50 disposed on the coupler member 22', the tang 50 serving as a support for the starting spring 28. This tang 50 pierces the end face of the hat-shaped cap 24'. As a result, the starting spring 28 is switched parallel to the idling spring 29, so that when the driver presses down on the gas pedal an increase is attained in the spring forces which characterize idling. This has the advantage that the starting shutoff rpm can be varied from outside by way of the gas pedal.

Because the pump work chamber 3 as well is supplied from the suction chamber 5 of the injection pump, the pressure in the suction chamber is subjected to certain fluctuations, because fuel is removed during each suction stroke and upon each compression stroke only the supply pump delivery is made at first, while subsequently the diverted quantity also reaches the suction chamber 5 by way of the pressure channel 6. These pressure fluctuations, which are independent of the rpm, can have a disadvantageous effect on control, and especially in the intermediate rpm range. In order to even out these pressure fluctuations for the hydraulic governor, the terminal portion 51 of the adjusting piston 14' is supported in a bore of the housing 1 which communicates via a channel 52 with the suction chamber 5. A damping throttle 53 is disposed in this channel 52 whose cross section is preferably adapted to the requirements for the final rpm. In addition, a predetermination of the possible stroke length of the adjusting piston 14' can be attained by way of a longitudinal groove 54 having a limited length and disposed in this terminal portion 51 of the adjusting piston.

In order to obtain good concentricity of the engine while it is still cold, it may be necessary to increase the injection quantity during idling. An increase of the idling quantity of this kind can be effected as follows: As long as the engine is still cold, the pressure in the suction chamber 5 is reduced slightly, as a result of which the adjusting piston 14 remains displaced somewhat further to the left by means of the idling spring 29; accordingly the annular slide 8 effects a correspondingly greater injection quantity. As shown in FIG. 1, a reduction of this kind in the pressure in the suction chamber 5 can be effected by permitting an outflow of a partial fuel quantity. This partial quantity flows out via a channel 55, which is controlled by a thermal valve 56 and by a throttle valve 57 in series therewith. The outflow channel 55 discharges into the spring chamber 43, which is relieved of pressure via the relief channel 36. The throttle valve 57 is initially adjusted to correspond to the maximum permissible outflow quantity. The thermal valve 56 operates with an expansible-substance governor 58, which is controlled by way of the engine coolant, which in turn is made to flow to and around the expansible-substance governor 58 by way of a system of channels 59. As soon as the engine temperature increases, the expansible-substance governor 58 effects a displacement of the movable valve member 60 and thus a reduction in or termination of the outflow of fuel. The quantity of fuel flowing out—that is, the additionally injected fuel quantity in the case of a cold engine—decreases uniformly as the temperature increases.

In FIG. 5, a corresponding control of the outflow quantity is shown for the purpose of increasing the idling fuel quantity in the case of a cold engine. Here, a magnetic valve 61 is used instead of a thermostatic valve 56. The magnetic valve 61 is controlled from the standpoint of the engine; as soon as the appropriate engine temperature has been attained, the movable valve element 60' blocks off the outflow channel 55.

The governor schematically shown in FIG. 4 corresponds in principle to the governor shown in FIG. 1. In contrast thereto, however, the spring plate bushing 31' is not supported on the housing 1, but is instead held in the illustrated position by the adaptation spring 34. As soon as the coupler member 22 is displaced into the full-load position, that is, as soon as it directly engages the intermediate spring plate 30 of the governor spring 33, the spring plate bushing 31' is pushed with its shoulder 35' against the plate of the cap 24, whereupon the adaptation spring 34 is correspondingly compressed. The situation is different in the partial-load range, in which the spring plate bushing 31' assumes the position relative to the cap 24 which is shown in FIG. 4, or some intermediate position which corresponds to the adaptation at a particular time. The advantage of this over the adaptation means shown in FIG. 1 is, in particular, that adaptation along the "natural" hydraulic full-load line is precluded.

An increase in the idling rpm when the engine is cold, shown by way of example in FIGS. 4 and 5, can also be combined with a corresponding adjustment of the injection time adjuster. The injection time adjuster is advantageously displaced in the direction of early injection when the engine is cold, so as to give the fuel in the combustion chamber sufficient time for preparation.

In FIG. 6 a combination of this kind is illustrated. In the housing 1 of the fuel injection pump, in addition to what is shown in FIG. 1, a roller ring 62 is supported in rotatable fashion, by means of which a cam disc (not shown) which is coupled to the pumping piston of the injection pump 2 is set into reciprocal motion. The rotatable cam disc is directly actuated by the drive shaft of the injection pump. An actuator element 63 is connected to the roller ring 62 and actuated by means of an injection time adjusting piston 18'. The fuel proceeds from the suction chamber 5 via a damping throttle 64 and a bore 65 each arranged in the piston 18' and thence to the end face 66 of the adjusting piston 18, thereby displacing this piston 18 against the force of the restoring spring 67. As a result it is attained that the beginning of the injection time is varied in accordance with the rpm. This adjustment is set for an internal combustion engine with normal operating temperature. When the engine is cold, however, the onset of injection should be adjusted toward "early" in the lower rpm range, so as to give the fuel sufficient time for preparation. In order to attain this adjustment toward "early", a stop lever 68 engages the actuator element 63 on the side remote from the roller ring 62, the lever being supported at 69 and adjustable via an expansible-substance controller 70. The expansible-substance controller 70 in turn is controlled by the engine coolant which is directed about the expansible-substance controller in the chamber 71. The position of the stop lever 68 corresponds to a warm engine, and it is for this reason that the injection adjusting piston 18' can assume its initial position. When the engine is cold, however, the control element 72 of the expansible-substance controller 70 is retracted, so that the stop lever 68 displaces the actuator element 63 toward the left, which corresponds to a displacement of the onset of injection toward "early". In order to effect a force-locking connection between the stop lever 68 and the control element 72, the stop lever 68 is acted upon by a spring 73 which exerts its force on the appropriate end of the stop lever 68. The spring 73 is supported on the side remote from the lever 68 on a piston 74 that is guided in a bore in the housing, said piston including a central bore 75 for receiving a valve slide 76. A radial bore 77 which communicates with the suction chamber 5 discharges into the central bore 75 under the control of the end face of the valve slide 76. The valve slide 76 is actuated by the stop lever 68 against the force of the restoring spring 78.

Depending on the temperature of the engine, that is, depending on the position of the valve slide 76, a larger or smaller quantity of fuel flows out of the suction chamber 5 into the central bore 75 and from there via a throttle bore 79 into a pressure-relief chamber 80 above the piston 74. The piston 74, and thus the control cross section at 82 between the radial bore 77 and the valve slide 76, can be preset by means of an adjusting screw 81. This embodiment of the invention insures on the one hand that, as described in more detail in connection with the example of FIG. 4, the reduction of the pressure in the suction chamber 5 attains an increase in idling rpm when the engine is cold; simultaneously when the engine is cold the injection time adjuster is displaced toward "early", although normally the reduction of pressure in the suction chamber 5, from the standpoint of the hydraulic adjustment of the injection time adjuster, would lead one to expect instead an adjustment toward "late".

A further exemplary embodiment of the subject of the invention is shown in FIGS. 7 and 8, wherein the adjusting piston 14' lies in an axially displaceable fashion on a rod 83 attached to the housing, said piston further including a corresponding central bore 84. This central bore 84 is closed on one end by a plug 85, which simultaneously acts as a contact element for a three-dimensional cam bolt 86 which is displaceable transversely relative to the adjusting piston 14'. A relief bore 87 is disposed in the rod 83 so that the chamber 88 at the end of the central bore 84 or of the rod 87 is relieved of pressure. The adjusting piston 14' is surrounded by the pressure which prevails in the suction chamber 5. As a result, a force results at the adjusting piston 14' leading away from the three-dimensional cam 86, with the appropriately embodied spring unit 15 acting counter thereto via the example shown in FIG. 1. The coupler member 22' is also supported on the rod 83, however it functions like that shown in FIG. 1. As may be seen in FIG. 8, the three-dimensional cam 86 is displaced out of its zero rpm position, that is, it is positioned entirely at the right toward the left by the increasing pressure in the suction chamber 5 and into the illustrated position, counter to the force of the starting spring 89. The adjusting piston 14', as in the example shown in FIG. 1, is displaced upward into a position for lower injection quantities (shut-off of the increased starting quantity). The particular advantage of this arrangement of the adjusting piston 14' and three-dimensional cam 86 is that the full-load adjustment can be realized independently of the partial-load adjustment. Naturally, the course of the curve or contour of the cam 86 and the set of springs 89 must be appropriately embodied.

It is increasingly necessary in fuel injection pumps to measure actual values (characteristic values) by means of transducers, these values then being utilized by electronic control devices to provide closed-loop or open-loop control. On the other hand, it is also increasingly important to be able to incorporate electrical controls into a fuel injection pump, for instance for synchronous control, shut-off and the like.

Figure 9:
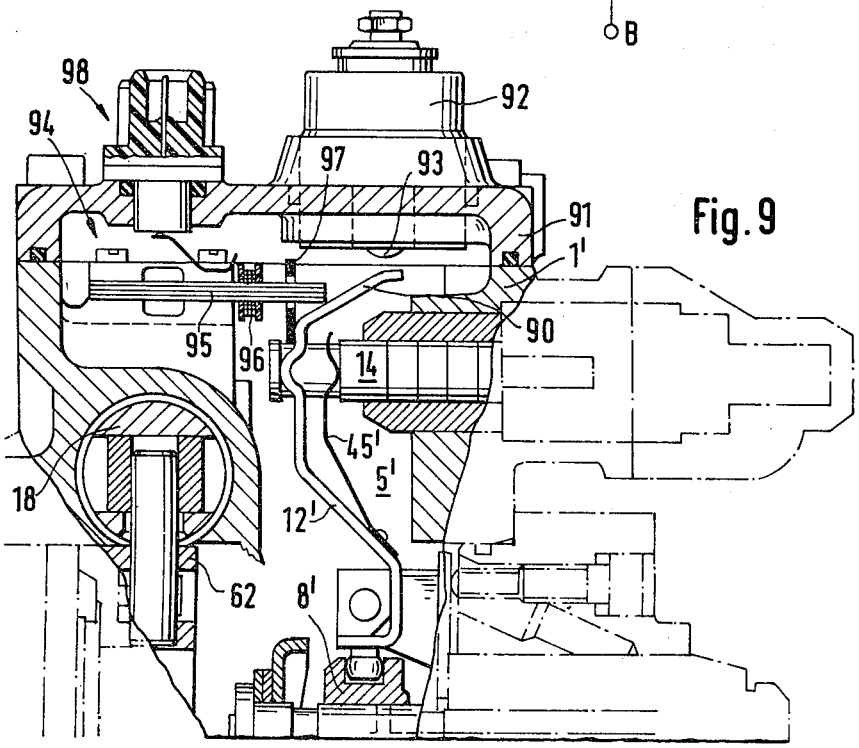
FIG. 9 shows a schematic view partially in cross section of the electrical transducers inside the pump.

In FIG. 9, a more practical fuel injection pump is shown, partially in cross section, and the governor disclosed here corresponds in principle to the exemplary embodiment shown in FIG. 1. The governor lever 12' disposed in the suction chamber 5' has an extended and bent end 90. An adjusting magnet 92 is disposed in a cap 91 of the housing 1 as shown. The armature 93 of the magnet is visible only as a cusp, is arranged to protrude out of the magnet 92 upon appropriate electrical switching and to thereby displace the governor lever 12' via its end 90 counter to the force of the play-compensating spring 45 in such a manner that the annular slide 8' assumes a position for zero supply quantity. The electrical switching may be accomplished in that when the magnet is energized the armature 93 is retracted into the magnet 92 and the injection pump can as a result only then begin to function (that is, the magnet is actuated via the ignition switch element), or the armature 93 can slide out of the magnet 92, as soon as the magnet is energized, which may be desired, for instance for the sake of a safety shut-off or an excess speed shut-off.

In FIG. 9 a transducer 94 is also shown with which the position of the annular slide 8' and thus the actual injection quantity can be measured. This transducer 94, which functions inductively, has a core 95 with an inductive coil 96, which are secured on the housing 1'. A short-circuit ring 97 is disposed in a contact-free manner about the core 95 and secured directly to the governor lever 12'. The measurement voltage and the measurement result are conveyed further by way of an electrical plug 98. The position of the injection adjusting piston 18 or of the roller ring 62 can also be measured in a similar manner. For the purposes of synchronous control, an electric servomotor, for example, can engage the coupler member 22, not shown here, which servomotor, triggered by an electronic control device, engages the spring unit 15 (see FIG. 7) or the adjusting piston 14. The necessary value for the rpm in such a process may be taken either from a pressure meter for the pressure in the suction chamber 5, because the pressure is proportional to rpm, or from an rpm transducer which is disposed on a rotating portion of the injection pump or of the engine. In every case control opportunities are offered by the pump according to the invention within very small space requirements, these opportunities being of mechanical, electrical, or of mixed nature. The purposes of making an adjustment in the control are particularly well served by the straight-line motion of the adjusting piston 14.

In FIG. 10 it is shown how electrical values of this kind can be utilized in an internal combustion engine system for exhaust gas recirculation. The metered fuel proceeds from the fuel injection pump 100 to an injection nozzle 101 which injects the fuel into the combustion chamber 102. In an electronic control device E, the output values A of the injection quantity and injection time from the injection pump and B from an rpm transducer are fed to the engine or the pump rpm in order then, mixing with various other engine characteristics C, to generate an adjustment value D, with which the exhaust gas recirculation valve 103 is actuated. An adjustment of the exhaust gas recirculation valve 103 takes place in accordance with the desired characteristic curve, with the exhaust 104 being made to communicate to a greater or lesser extent via a recirculation line 105 with the intake line 106 of the engine. In the process of mixing or combining various engine characteristics, the characteristic of the exhaust gas recirculation valve 103 is taken into consideration in accordance with an optimum pump or exhaust gas recirculation performance graph. The advantage of this combining in accordance with performance graphs is that a high degree of precision is attained, even when the position of the annular slide 8' does not represent a direct standard for load.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection pump with a housing and hydraulic rpm governor for internal combustion engines, the fuel injection pump having:

a supply pump with a suction chamber in which fuel is driven by the supply pump at a pressure depending on engine rpm, and wherein the supply pump is driven at an rpm also depending on engine rpm;

an adjusting piston in the housing, with an end face exposed to the supply pump fuel such that the adjusting piston is moved in a first direction;

a spring unit with an rpm governing spring connected to and controlled by the hydraulic rpm governor and also connected to move the adjusting piston in a second direction;

an adjusting lever connected to operate the spring unit such that an adjustment of the adjusting lever varies the tension in the rpm governor spring;

a distributor mounted in the housing parallel to the adjusting piston;

an annular slide mounted on the distributor;

a governor lever having first and second ends, which is mounted on a pivot and is connected at the first end to be operated by the adjusting piston and connected at the second end to the annular slide to position the annular slide on the distributor;

said spring unit having at least two additional springs of unequal strength, a first spring of said spring unit functioning as a starting spring and cooperating with said adjusting piston and a second spring of said spring unit cooperating with said governor spring, said second spring arranged to engage said adjusting piston via cap which is supported during starting on said housing and guided on said adjusting piston.

2. A fuel injection pump with a housing and hydraulic rpm governor for internal combustion engines, the fuel injection pump having:

a supply pump with a suction chamber in which fuel is driven by the supply pump at a pressure depending on engine rpm, and wherein the supply pump is driven at an rpm also depending on engine rpm;

an adjusting piston in the housing, with an end face exposed to the supply pump fuel such that the adjusting piston is moved in a first direction;

a spring unit with an rpm governing spring connected to and controlled by the hydraulic rpm governor and also connected to move the adjusting piston in a second direction;

an adjusting lever connected to operate the spring unit such that an adjustment of the adjusting lever varies the tension in the rpm governor spring;

a distributor mounted in the housing parallel to the adjusting piston;

an annular slide mounted on the distributor;

a governor lever having first and second ends, which is mounted on a pivot and is connected at the first end to be operated by the adjusting piston and connected at the second end to the annular slide to position the annular slide on the distributor; and said governor lever at least indirectly engages an electrical servomotor whereby during the adjustment of said servomotor the position of said adjusting piston remains unchanged.

3. A fuel injection pump with a housing and hydraulic rpm governor for internal combustion engines, the fuel injection pump having:

a supply pump with a suction chamber in which fuel is driven by the supply pump at a pressure depending on engine rpm, and wherein the supply pump is driven at an rpm also depending on engine rpm;

an adjusting piston in the housing, with an end face exposed to the supply pump fuel such that the adjusting piston is moved in a first direction;

a spring unit with an rpm governing spring connected to and controlled by the hydraulic rpm governor and also connected to move the adjusting piston in a second direction;

an adjusting lever connected to operate the spring unit such that an adjustment of the adjusting lever varies the tension in the rpm governor spring;

a distributor mounted in the housing parallel to the adjusting piston;

an annular slide mounted on the distributor;

a governor lever having first and second ends, which is mounted on a pivot and is connected at the first end to be operated by the adjusting piston and connected at the second end to the annular slide to position the annular slide on the distributor, said adjusting piston controlling a channel leading to said suction chamber and being guided in a bore in a sleeve member, said sleeve member including an annular groove in communication with said channel, said adjusting piston arranged to overlap to a greater or lesser extent said annular groove for the purpose of controlling the cross section thereof.

4. A fuel injection pump as claimed in claim 1, characterized in that said spring unit is operable by a coupler means including rack and pinion means.

5. A fuel injection pump as claimed in claim 1, characterized in that said spring unit further comprises a spring plate bushing, said bushing arranged to slidably receive an intermediate spring plate, said intermediate spring plate adapted to support an idling spring, coupler means cooperative with said idling spring and stop means on said spring plate bushing to interrupt pressure on said governor spring by said coupler means.

6. A fuel injection pump as claimed in claim 5, characterized in that said spring plate bushing embraces a spring plate sleeve provided with a shoulder and an adaptation spring interposed between said shoulder and said spring plate bushing.

7. A fuel injection pump as claimed in claim 1, characterized in that said adjusting piston has a closed end and is slidably disposed on a carrier rod having a terminus, said closed end of said adjusting piston and said terminus of said carrier rod arranged to form a pressure-relieved chamber.

8. A fuel injection pump as claimed in claim 7, characterized in that said adjustment piston is a hollow piston the initial position of which is determined by a starting piston, said starting piston being transversely displaceable by means of a counter stop, said piston being displaceable over the entire rpm range by the fluid pressure acting counter to the pressure of an axially disposed spring.

9. A fuel injection pump as claimed in claim 1, characterized in that said governor lever at least indirectly engages an electrical servomotor whereby during the adjustment of said servomotor the position of said adjusting piston remains unchanged.

10. A fuel injection pump as claimed in claim 9, characterized in that said governor lever is urged in a direction of a small injection quantity by means of a drag spring which permits a sufficient amount of play relative to said rpm governor.

11. A fuel injection pump as claimed in claim 9, characterized in that said servomotor includes an armature which is retracted into the coil counter to the action of a spring, so that the fuel shuts off when the magnet is shut off being triggered by way of the spring of said servomotor and by said armature.

12. A fuel injection pump as claimed in claim 1, characterized in that an rpm-dependent pressure actuated valve is disposed in said housing and is arranged to vary the injection quantity flow, said valve being arranged to be opened by means of a servomotor in accordance with the temperature of said internal combustion engine when the engine is cold, so that the control pressure as a result is lower and the injection quantity is larger than when the engine is warm and the valve is closed.

13. A fuel injection pump as claimed in claim 12, characterized in that said valve is positioned in proximity to a relief channel and flow past said valve enters into a pressure-relieved chamber in which said spring unit is disposed.

14. A fuel injection pump as claimed in claim 12, characterized in that said fuel injection pump further includes an apparatus for the rpm-dependent adjustment of the injection time, said adjustment being achieved by another servomotor whereby the injection onset is adjustable toward "early" when the engine is cold.

15. A fuel injection pump as claimed in claim 1, characterized in that said adjusting piston controls a channel which leads to said suction chamber, whereby a partial quantity of control fluid can be made to flow out of said channel in order to effect the control pressure.

16. A fuel injection pump as claimed in claim 15, characterized in that said adjusting piston is guided in a bore in a sleeve member, said sleeve member including an annular groove in communication with said channel, said adjusting piston arranged to overlap to a greater or lesser extent said annular groove for the purpose of controlling the cross section thereof.

17. A fuel injection pump as claimed in claim 14, characterized in that said adjusting piston comprises a hollow piston having a bore, said bore communicating with a pressure-relieved chamber.

18. A fuel injection pump as claimed in claim 13, characterized in that the relief cross section is reduced with increasing rpm and with increasing load.

19. A fuel injection pump as claimed in claim 1, characterized in that a transducer evaluates the travel path of the adjusting piston as a characteristic value in an electronic control device containing a performance-graph memory for actuating an exhaust gas recirculation value for the purpose of controlling exhaust gas recirculation.

* * * * *